US007299768B2

(12) United States Patent
Groehl

(10) Patent No.: US 7,299,768 B2
(45) Date of Patent: Nov. 27, 2007

(54) GAS-FIRED WATER HEATING APPARATUS

(75) Inventor: Alexander Groehl, Dolgesheim (DE)

(73) Assignee: Ceramat, S.coop., Asteasu (Gipuzkoa) (ES)

( * ) Notice: Subject to any disclaimer, the term of this patent is extended or adjusted under 35 U.S.C. 154(b) by 0 days.

(21) Appl. No.: 11/209,242

(22) Filed: Aug. 23, 2005

(65) Prior Publication Data

US 2006/0042564 A1 Mar. 2, 2006

(30) Foreign Application Priority Data

Aug. 27, 2004 (DE) ..... 10 2004 041 818

(51) Int. Cl.
*F24H 1/00* (2006.01)

(52) U.S. Cl. ..... 122/17.1; 122/155.1; 122/13.01

(58) Field of Classification Search ..... 122/13.01, 122/14.1, 17.1, 17.2, 18.3, 155.1
See application file for complete search history.

(56) References Cited

U.S. PATENT DOCUMENTS 2,374,757 A * 5/1945 Koppel ..... 122/14.3
4,372,290 A * 2/1983 Visos et al. ..... 431/119
4,492,185 A * 1/1985 Kendall et al. ..... 122/32
4,510,890 A * 4/1985 Cowan ..... 122/18.3
4,735,174 A * 4/1988 Crump ..... 122/177
4,925,093 A * 5/1990 Moore et al. ..... 237/19
4,953,510 A 9/1990 Akkala et al.
5,074,464 A * 12/1991 Moore et al. ..... 237/19
5,875,739 A 3/1999 Joyce
6,334,411 B1 * 1/2002 Lesage et al. ..... 122/18.1
6,418,884 B1 * 7/2002 Rucker ..... 122/504
6,497,200 B2 * 12/2002 Stretch et al. ..... 122/504
6,698,385 B1 * 3/2004 Lesage ..... 122/13.01
6,725,811 B1 * 4/2004 Moore et al. ..... 122/13.01
7,013,841 B1 * 3/2006 Boros et al. ..... 122/19.2
2003/0111023 A1 6/2003 Carbone et al.

FOREIGN PATENT DOCUMENTS

DE 2239295 8/1972
DE 2330934 1/1975

* cited by examiner

*Primary Examiner*—Gregory Wilson
(74) *Attorney, Agent, or Firm*—Michael J. Striker

(57) ABSTRACT

The water heating apparatus has an upright cylindrical thermally insulated storage tank, an axially extending exhaust gas pipe passing centrally through the storage tank and a combustion chamber under the storage tank. An atmospheric gas burner, which has a complete premixing fuel gas/air supply system, is arranged within the combustion chamber. The exhaust gas pipe has a section extending within the combustion chamber, which preferably extends towards the bottom of the combustion chamber and has an end located a few centimeters from the bottom, so that the combustion gases have a longer dwell time in the combustion chamber and the exhaust gas pipe in order to improve heating efficiency.

11 Claims, 4 Drawing Sheets

GAS-FIRED WATER HEATING APPARATUS

BACKGROUND OF THE INVENTION

1. Field of the Invention

The present invention relates to a gas-fired water heating apparatus, which comprises an upright cylindrical thermally insulated water tank, an axially extending exhaust gas pipe passing centrally through the water tank and a combustion chamber under the water tank, in which an atmospheric gas burner is arranged, which has a complete premixing fuel gas/air supply system.

2. Related Art

Gas-fired water heating apparatuses are marketed in many embodiments for different applications. They are used for providing hot water in living quarters or a home. A typical unit for example is the so-called boiler for a hot water supply.

The present invention especially relates to a special gas-fired water heating apparatus, the so-called "water heater" marketed in the USA. This water heater is widely distributed in the USA and is used, for example, in households, workplaces and small industrial operations to provide a free-standing hot water supply for supplying hot water, for example for a shower.

This "water heater" has a typical structure, as described in U.S. Pat. No. 4,953,510. The central component of the water heater is a cylindrical, longitudinally extended storage tank, through which an exhaust pipe extends and which stands freely on the ground on feet.

An atmospheric gas burner with suitable power is arranged in a combustion chamber under the storage tank, whose lower wall is cup-shaped. The hot exhaust gas including the combustion products from the gas burner acts on the bottom of the storage tank and subsequently rises through an elongated exhaust pipe. In this type of water heater the hot gas flowing upward in the exhaust pipe comes into contact with the interior surfaces of the exhaust pipe, while the water in the storage tank is in contact with the outer surfaces of the exhaust pipe. While the combustion proceeds, the water within the water tank is heated by heat conduction through the wall of the exhaust flue. In this type of water heater normally a longitudinal separating wall (baffle) is arranged within the exhaust gas pipe in order to improve the efficiency of the heat transfer through the wall of the exhaust gas pipe from the hot combustion air to the water within the water tank. Furthermore the outer surfaces of the storage tank are typically covered with thermal insulation, in order to reduce heat loss from the water both during heating of the water and after the combustion process is halted.

Increasingly strict legal regulations regarding avoiding accidents, especially when combustible vapors arrive in the open combustion region, and in regard to improvement of exhaust gas content, have led to developments in the water heater field, which provide a nearly completely closed combustion (burner) chamber, in which a complete premixing gas burner, a so-called pre-mix burner, is arranged.

This sort of water heater is described in U.S. Pat. No. 5,875,739. The structure and arrangement of the prior art pre-mix burner in the closed combustion chamber is shown in the appended FIG. 1, which is taken from the above-mentioned U.S. patent. This figure is a cross-sectional view of a water heater with a water tank or storage tank 1 and a nearly closed combustion chamber 2, to which an exhaust gas pipe 3 is connected, which extends through the center of the water tank 1. The combustion chamber 2 and the storage tank 1 are insulated from the surroundings by thermal insulation 4. An atmospheric pre-mix burner 5 is arranged within the combustion chamber 2, which comprises a mixing chamber 6 and a spherical burner mat 7. A Venturi 8 is connected to the mixing chamber 6, which extends through the thermal insulation 4 until at the outer surface of the water heater. A nozzle 10 for supplying the fuel gas is arranged within the outer opening of the Venturi 8. Primary air is drawn through the outer entrance opening 9, while fuel gas from nozzle 10 flows into the Venturi 8. The primary air is then mixed by turbulence with the fuel gas in the mixing chamber 6.

Another embodiment of a water heater with a complete premixing atmospheric gas burner is described in U.S. Patent Application 2003/0111 023 A1. This known gas burner 5 has a planar rectangular burner mat.

Using an atmospheric complete pre-mixing gas burner in a water heating apparatus of the above-described type allows the gas burner to be placed centrally in the combustion space, i.e. the combustion chamber, in order to attain a uniform heat transfer in all directions or to all sides.

The exhaust gas flow is directed so that the hot exhaust gases, understood herein to be combustion air, flow more or less directly from the combustion chamber into the exhaust pipe, because of the existing typical structure of the combustion system in the above-described water heating apparatus with the central exhaust pipe, which is connected flush with the lower cup-shaped wall of the storage tank and extends upward from it.

This has the following consequences:

1. Heat transfer in the bottom region, usually characterized as the dome, is not complete; and 2. Hot exhaust gas flows though the "exhaust channel" at comparatively high speed, so that the efficiency is limited. It can be increased by the so-called "baffle" in the exhaust gas pipe, but that impairs the quality of the combustion in a disadvantageous way, since the exhaust gas ratio $NO_x$/CO is poor.

SUMMARY OF THE INVENTION

It is an object of the present invention to provide a gas-fired water heating apparatus of the above-described kind, in which the heating efficiency is increased in relation to the prior art without disadvantageously influencing the quality of the combustion processes.

It is an object of the present invention to provide a gas-fired water heating apparatus of the above-described type, especially including a nearly completely closed combustion (burner) chamber, in which a complete premixing gas burner, a so-called pre-mix burner, is arranged, in which the heating efficiency is increased in relation to the prior art water heating apparatus of this type, while, at the same time, producing exhaust gases that are environmentally more acceptable than those of the prior art water heating apparatus of this type.

These objects and others, which will be made more apparent hereinafter, are attained in a water heating apparatus comprising an upright cylindrical thermally insulated storage tank, an axially extending exhaust gas pipe passing centrally through the storage tank and a combustion chamber under the storage tank, within which an atmospheric gas burner is arranged, which has a complete premixing fuel gas/air supply system.

According to the invention the exhaust gas pipe has a section extending within the combustion chamber.

Because of the structure of the water heating apparatus of the invention, especially the arrangement of the section of the exhaust gas pipe within the combustion chamber, the combustion gases, namely the combustion air, flow along the entire bottom region of the combustion chamber (dome), i.e. the combustion air is held in the combustion chamber as long as possible in order to increase the heat transfer in the vicinity of the dome.

Furthermore the hot fuel gas is slowed further by the geometric form of the exhaust gas pipe section extending into the combustion chamber, which again causes an improvement in heat transfer in the exhaust gas pipe.

As an additional point, the exhaust gas cooled in the bottom region does not produce the usual chimney effect. Thus a still further slowing down of the exhaust gas takes place and there is an even longer dwell time for the exhaust gas in the apparatus.

Preferred embodiments of the claimed invention are characterized in the appended dependent claims and described in the detailed description below.

In preferred embodiments of the invention the section of the exhaust gas pipe within the combustion chamber extends deeply into the combustion chamber and into the vicinity of a bottom of the combustion chamber, preferably within 2 to 3 cm of the bottom of the combustion chamber.

Preferably the section of the exhaust gas pipe within the combustion chamber is aligned with a remaining portion of the exhaust gas pipe that passes centrally through the storage tank, i.e. it is straight and points toward the bottom of the combustion chamber. The section can be in one piece with the remaining portion of the exhaust gas pipe or it can be a separate part connected by a screw connection with the remaining portion.

A pressure relief valve can be provided in the bottom of the combustion chamber to help to provide stable combustion without resonances.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 2:
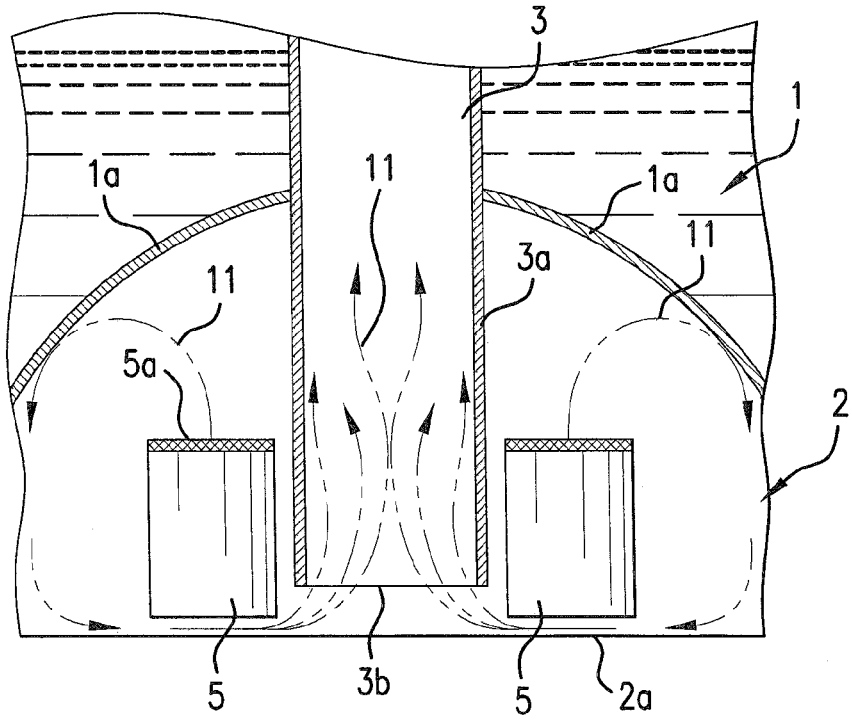
FIG. 2 is a cutaway diagrammatic cross-sectional view of the basic structure of a gas-fired water heater according to the invention, including a storage tank, under which a combustion chamber is arranged, and an exhaust gas flue passing centrally through the storage tank, which extends deeply into the combustion chamber.

FIG. 2 is a diagrammatic cross-sectional view showing the basic structure of the water heater according to the invention with a cylindrical water storage tank 1, through which an exhaust gas pipe 3 passes centrally and which has a cup-shaped curved lower wall 1*a*, under which the combustion space, namely the combustion chamber 2, is located.

The above-described basic structure is known and does not need to be described in further detail.

The atmospheric gas burner 5 with its burner surface 5*a* and a complete pre-mixing fuel gas/air supply system as in the prior art (see FIG. 1) are arranged within the combustion chamber 2 and, indeed, so that the bottom of the gas burner 5 is located with a small space of a few mm above the bottom 2*a* of the combustion chamber 2.

The term "atmospheric gas burner" means a burner, which burns the fuel gas without blower assistance.

Figure 1:
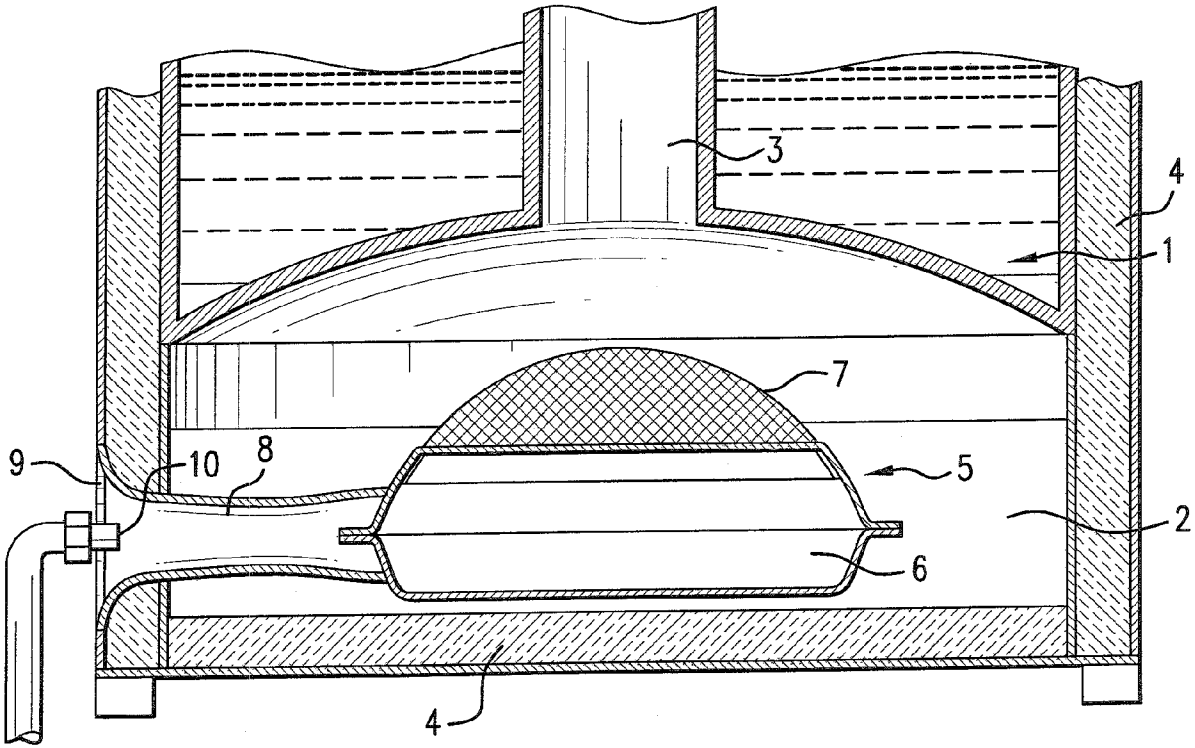
FIG.1 PRIOR ART
FIG. 1 is a longitudinal cross-sectional view of a prior art water heater with a complete pre-mixing gas burner with a spherical combustion surface.

The typical structure of a complete pre-mixing fuel gas/air supply system comprises a Venturi 8, a fuel gas nozzle 10 and entrance opening 9 for primary air, is known in the art and is shown in FIG. 1. This typical structure does not need to be described in further detail in order to understand the present invention.

Figure 3:
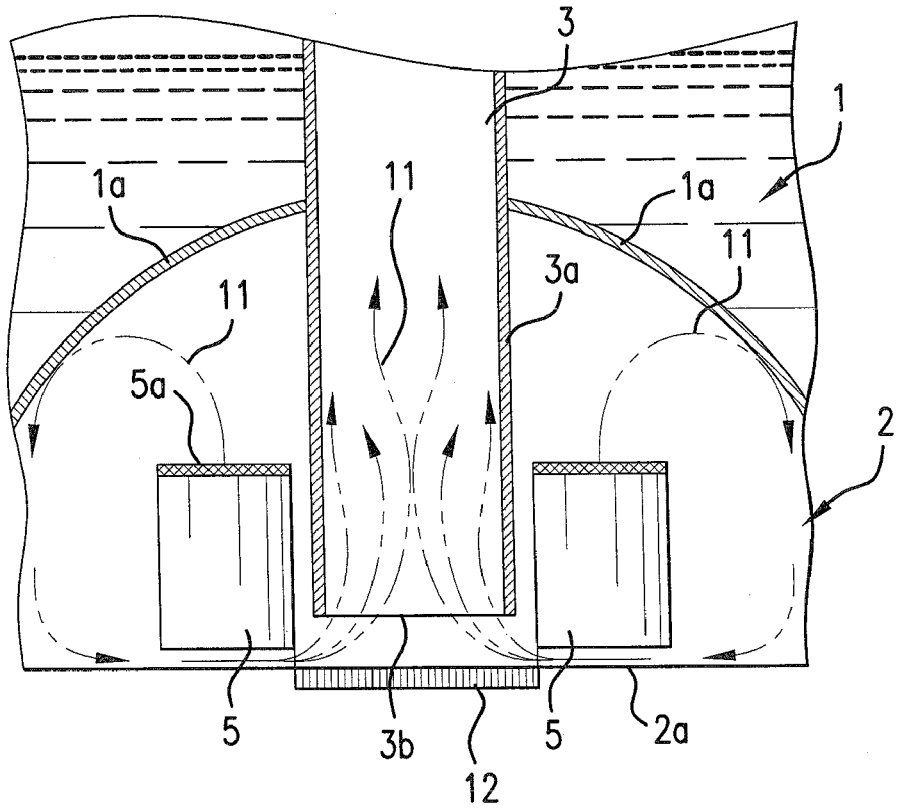
FIG. 3 is a cutaway diagrammatic cross-sectional view of another embodiment of the water heater according to the invention with the same structure as the water heater shown in FIG. 2, except that a perforated plate acting as a pressure relief valve is arranged in the bottom of the combustion chamber.

According to the invention, as shown in FIGS. 2 and 3, the exhaust gas pipe 3 extends "deeply" through the combustion chamber 2 until shortly before the combustion chamber bottom 2*a*. In other words, the exhaust gas pipe 3 passes through most of or a major portion of the combustion chamber, leaving only a small gap between the free end of the exhaust gas pipe 3 and the bottom 2*a*. The free end of the exhaust gas pipe 3 is typically about 2 to 3 cm above the combustion chamber bottom 2*a*. These values are to be viewed as advantageous.

When the exhaust gas pipe 3, as shown in FIGS. 2 and 3, extends centrally into the combustion chamber 2 and the gas burner 5 is arranged centrally in the combustion chamber, the gas burner 5 is shaped like a hollow cylinder with a ring-shaped burner surface 5*a*. In the embodiments of FIGS. 2 and 3 an inlet of the exhaust gas pipe 3 is below the burner surface 5*a*.

As shown in FIG. 2, the exhaust gas flow 11, the combustion air, depends on the arrangement of the gas burner 5 and the exhaust gas pipe 3 extends until near the bottom 2*a* of the combustion chamber 2. The exhaust gas flow 11 passes over a long path, first along the outer wall of the section 3*a* of the exhaust gas pipe 3 extending into the combustion chamber 2 and then along the cup-shaped lower wall 1*a* of the storage tank 1, which results in an intense heating of the storage tank 1 and the outer wall of the exhaust gas pipe 3. Then it flows along the bottom 2*a* of the combustion chamber, after being guided on the lower wall 1*a*, to the inlet 3*b* for exhaust gas at the free end of the exhaust gas pipe 3 and rises subsequently in the exhaust pipe. Because of that the hot combustion air is retained for a comparatively long time in the vicinity of the combustion chamber 2 and this increases the heat transfer in the vicinity of the dome, especially because the exhaust gas flow is slowed down.

In FIG. 3 another embodiment of the gas-fired water heater according to FIG. 2 is shown, in which a perforated plate 12 acting as a pressure relief valve is arranged or built in the bottom 2*a* of the combustion chamber 2. This pressure relief valve prevents the build up of pressures during combustion and thus the resonances connected with this pressure build up, so that the combustion can operate in a stable manner. The remaining portion of the embodiment of the gas-fired water heater shown in FIG. 3 is the same as that shown in FIG. 2.

Figure 4:
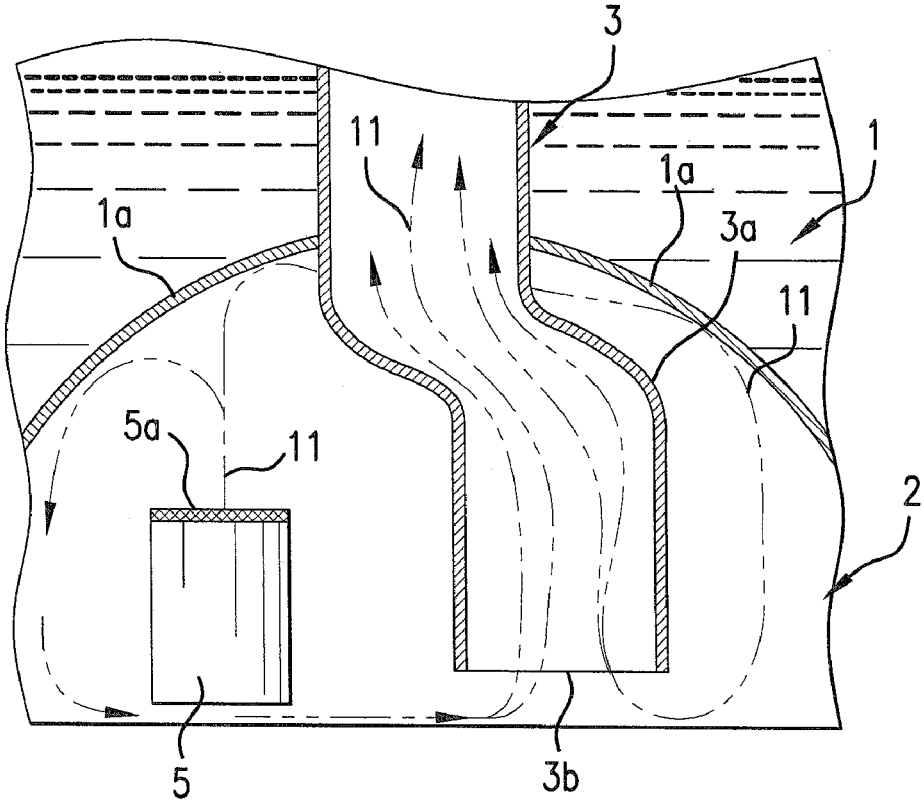
FIG. 4 is a cutaway diagrammatic cross-sectional view of a further embodiment of the water heater according to the invention with a structure similar to that shown in FIG. 2, but with a different exhaust gas pipe form.

In the gas-fired water heater shown in FIGS. 2 and 3 the section 3*a* of the central exhaust flue 3 extending within or into the combustion chamber 2 is centrally arranged within the combustion chamber 2. However the section 3*a* of the exhaust gas pipe 3 may take other positions within the combustion chamber 2. The extension or section of the exhaust gas pipe 3 within the combustion chamber may be directed, as shown in FIGS. 2 and 3, toward the combustion chamber bottom, but also can be arranged to point in other directions, as shown in FIG. 4. The inlet 3*b* of the section 3*a* can also point in another direction than toward the bottom 2*a* of the combustion chamber 2, for example toward the side as shown in FIG. 4. Also the section 3*a* can be arranged eccentric to a remaining portion of the exhaust gas pipe 3 that passes through the storage tank 1.

The section 3*a* of the exhaust gas pipe 3 can be in one piece with a remaining portion of the exhaust gas pipe 3 that passes through the storage tank 1. However it can also be a separate part, which is connected to the remaining portion of the exhaust gas pipe 3. The connection can be a screw connection by means of a flange-type part or section. The cross-section of the section 3*a* of the exhaust gas pipe 3 extending within the combustion chamber can be circular, triangular or oval or even any free form.

The disclosure in German Patent Application 10 2004 041 818.7-16 of Aug. 27, 2004 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a gas-fired water heating apparatus, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constituted essential characteristics of the generic or specific aspects of this invention.

What is claimed is new and is set forth in the following appended claims.

I claim:

1. A gas-fired water heating apparatus comprising an upright cylindrical thermally insulated storage tank, an axially extending exhaust gas pipe passing centrally through the storage tank, said exhaust gas pipe being provided with an inlet for admitting exhaust gas at a free end thereof, a combustion chamber arranged under the storage tank, and an atmospheric gas burner arranged within the combustion chamber, said atmospheric gas burner having a complete premixing fuel gas/air supply system;

in which the exhaust gas pipe has a pipe section extending within the combustion chamber and the pipe section of the exhaust gas pipe within the combustion chamber extends deeply into the combustion chamber until said free end is in the vicinity of a bottom of the combustion chamber, and in which the pipe section of the exhaust gas pipe within the combustion chamber is arranged eccentrically to a remaining portion of the exhaust gas pipe that passes centrally through the storage tank.

2. The water heating apparatus as defined in claim 1, wherein the pipe section of the exhaust gas pipe within the combustion chamber is not pointing toward the bottom of the combustion chamber.

3. The water heating apparatus as defined in claim 1, wherein the pipe section of the exhaust gas pipe extending within the combustion chamber is in one piece with said remaining portion of the exhaust gas pipe that passes centrally through the storage tank.

4. The water heating apparatus as defined in claim 1, wherein the pipe section of the exhaust gas pipe extending within the combustion chamber is a separate part from said remaining portion of the exhaust gas pipe that passes centrally through the storage tank.

5. The water heating apparatus as defined in claim 1, wherein the pipe section of the exhaust gas pipe extending within the combustion chamber has a cross-section that is circular, triangular, oval, or in a free form.

6. A gas-fired water heating apparatus comprising an upright cylindrical thermally insulated storage tank, an axially extending exhaust gas pipe passing centrally through the storage tank, said exhaust gas pipe being provided with an inlet for admitting exhaust gas at a free end thereof, a combustion chamber arranged under the storage tank, an atmospheric gas burner arranged within the combustion chamber, said atmospheric gas burner having a complete premixing fuel gas/air supply system, and a perforated plate acting as a pressure relief valve, said perforated plate being built into a bottom of the combustion chamber;

in which the exhaust gas pipe has a pipe section extending within the combustion chamber and the pipe section of the exhaust gas pipe within the combustion chamber extends deeply into the combustion chamber until in the vicinity of the bottom of the combustion chamber.

7. A gas-fired water heating apparatus comprising an upright cylindrical thermally insulated storage tank, an axially extending exhaust gas pipe passing centrally through the storage tank, said exhaust gas pipe being provided with an inlet for admitting exhaust gas at a free end thereof, a combustion chamber arranged under the storage tank, and an atmospheric gas burner arranged within the combustion chamber, said atmospheric gas burner having a complete premixing fuel gas/air supply system;

in which the exhaust gas pipe comprises a pipe section that extends a sufficient distance into the combustion chamber, so that an exhaust gas flow from the gas burner passes over a path that extends first along an outer wall of said pipe section, subsequently along a bottom wall of the storage tank and then along a bottom of the combustion chamber prior to passing into said inlet of the exhaust gas pipe, and in which the pipe section of the exhaust gas pipe within the combustion chamber is arranged eccentrically to a remaining portion of the exhaust gas pipe that passes centrally through the storage tank.

8. A gas-fired water heating apparatus comprising an upright cylindrical thermally insulated storage tank, an axially extending exhaust gas pipe passing centrally through the storage tank, said exhaust gas pipe being provided with an inlet for admitting exhaust gas at a free end thereof, a combustion chamber arranged under the storage tank, an atmospheric gas burner arranged within the combustion chamber, said atmospheric gas burner having a burner surface and a complete premixing fuel gas/air supply system, and a perforated plate acting as a pressure relief valve, said perforated plate being built into a bottom of the combustion chamber;

in which the exhaust gas pipe comprises a pipe section that extends a sufficient distance into the combustion chamber, so that an exhaust gas flow from the gas burner passes over a path that extends first along an outer wall of said pipe section, subsequently along a bottom wall of the storage tank and then along the bottom of the combustion chamber prior to passing into said inlet of the exhaust gas pipe.

9. A gas-fired water heating apparatus comprising an upright cylindrical thermally insulated storage tank, an axially extending exhaust gas pipe passing centrally through the storage tank, said exhaust gas pipe being provided with an inlet for admitting exhaust gas at a free end thereof, a combustion chamber arranged under the storage tank, and an atmospheric gas burner arranged within the combustion chamber, said atmospheric gas burner having a burner surface and a complete premixing fuel gas/air supply system;

in which the exhaust gas pipe comprises a pipe section extending into the combustion chamber so that said inlet is below said burner surface of the gas burner, whereby the exhaust gas from the gas burner has an increased dwell time in the combustion chamber and heat transfer from the exhaust gas in the combustion chamber to the storage tank is more efficient, and in which the pipe section of the exhaust gas pipe within the combustion chamber is arranged eccentrically to a remaining portion of the exhaust gas pipe that passes centrally through the storage tank.

10. A gas-fired water heating apparatus comprising an upright cylindrical thermally insulated storage tank, an axially extending exhaust gas pipe passing centrally through the storage tank, said exhaust gas pipe being provided with an inlet for admitting exhaust gas at a free end thereof, a combustion chamber arranged under the storage tank, an atmospheric gas burner arranged within the combustion chamber, said atmospheric gas burner having a burner surface and a complete premixing fuel gas/air supply system, and a perforated plate acting as a pressure relief valve, said perforated plate being built into a bottom of the combustion chamber;

in which the exhaust gas pipe comprises a pipe section extending into the combustion chamber so that said inlet to the exhaust gas pipe is below said burner surface, whereby the exhaust gas from the gas burner has an increased dwell time in the combustion chamber and heat transfer from the exhaust gas in the combustion chamber to the storage tank is more efficient.

11. A gas-fired water heating apparatus comprising an upright cylindrical thermally insulated storage tank having a cup-shaped curved bottom wall, a combustion chamber arranged under the cup-shaped curved bottom wall of the storage tank, an atmospheric gas burner arranged within the combustion chamber, said atmospheric gas burner having a burner surface and a complete premixing fuel gas/air supply system; and an axially extending exhaust gas pipe passing centrally through the storage tank and provided with an inlet for admitting exhaust gas at a free end thereof, said exhaust gas pipe comprising a pipe section extending within the combustion chamber with said inlet positioned below said burner surface, so that the exhaust gas first passes along an outer wall of said pipe section, then along the cup-shaped curved bottom wall of the storage tank and then along a bottom of the combustion chamber before entering said inlet, whereby said exhaust gas thus has an increased dwell time in the combustion chamber and heat transfer from the exhaust gas to the storage tank is more efficient, wherein said pipe section of the exhaust gas pipe within the combustion chamber is arranged eccentrically to a remaining portion of the exhaust gas pipe that passes centrally through the storage tank.

* * * * *